US005586710A

United States Patent [19]

Golicz

[11] Patent Number: 5,586,710

[45] Date of Patent: Dec. 24, 1996

[54] POWER STAPLER

[75] Inventor: Roman M. Golicz, Clinton, Conn.

[73] Assignee: Roll Systems, Inc., Burlington, Mass.

[21] Appl. No.: 180,427

[22] Filed: Jan. 12, 1994

Related U.S. Application Data

[63] Continuation-in-part of Ser. No. 976,275, Nov. 13, 1992, abandoned.

[51] Int. Cl.[6] ..... B25C 7/00

[52] U.S. Cl. ..... 227/155; 227/131

[58] Field of Search ..... 227/155, 131,140, 227/154

[56] References Cited

U.S. PATENT DOCUMENTS

| | | |
|---|---|---|
| 1,612,870 | 1/1927 | Leschhorn . |
| 4,546,910 | 10/1985 | Logtens . |
| 4,593,847 | 6/1986 | Hagemann . |
| 4,792,077 | 12/1988 | Faltin . |
| 5,004,142 | 4/1991 | Olesen . |
| 5,029,745 | 7/1991 | Akizawa et al. . |

FOREIGN PATENT DOCUMENTS

| | | |
|---|---|---|
| 0009964 | 4/1980 | European Pat. Off. . |
| 0322906 | 7/1989 | European Pat. Off. . |
| 4020355 | 1/1992 | Germany . |
| 2019764 | 11/1979 | United Kingdom . |
| 2024083 | 1/1980 | United Kingdom . |
| WO90/08015 | 7/1990 | WIPO . |

OTHER PUBLICATIONS

Spehrley, Jr., Charles J., Xerox Disclosure Journal, Semi--Active Clincher, vol. 8, No. 3, May Jun. 1983, pp. 187–188.

*Primary Examiner*—Rinaldi I. Rada
*Assistant Examiner*—Allan M. Schrock
*Attorney, Agent, or Firm*—Cesari and McKenna

[57] ABSTRACT

A power stapler having a clincher provides a stitcher head for driving formed staples into a stack of sheets. A clincher box is positioned opposite the stitcher head. Clinchers located in the clincher box pivot upwardly under the force of a moving clincher bar to deform ends of the staple to pass through the sheet stack. The clincher bar or clinchers include a stop that limits retraction of the clinchers into the box. Hence, as the staple is driven by the stitcher head through the sheets, the ends of the staple are brought into engagement with the clinchers and plastically deform into a substantially inwardly curled shape. Following driving of the staple by the stitcher head, the clincher bar is actuated to rotate the clinchers upwardly toward the stack causing the curled tips of the staple to drive into the sheets. The clinchers can include grooves that are angled into alignment along parallel angled lines so that the ends of the staple pass each other and do not interfere with each other upon clinching.

9 Claims, 7 Drawing Sheets

POWER STAPLER

RELATED APPLICATION

This application is a continuation-in-part of U.S. patent application Ser. No. 07/976,275, filed on Nov. 13, 1992 now abandoned.

FIELD OF THE INVENTION

This invention relates to a power stapler and more particularly to an improved clinching head for use in a power stapler.

BACKGROUND OF THE INVENTION

Power staplers operated by pneumatic and/or electric actuators are widely used in document handling and document creation applications. Photocopiers and laser printers often incorporate a power stapler or "stitcher" in their mechanism to provide optional binding of completed documents.

FIG. 1 is an example of a typical implementation for a stitcher 10. A set of printed sheets 12 are fed either one at a time or as a group (as shown) to the stitcher 14.

The stitcher 14, itself, comprises an electromechanical and/or pneumatic stitcher shown schematically. A known stitcher such as the Hohner Universal 52/8 is contemplated. However, the principles of this invention are applicable to virtually any known stitcher mechanism. The stitcher 14 forms wire staples or "stitches" 16 as shown from a fed coil 18 of staple wire 20 in a conventional manner. The staple 16 is driven as shown by the arrows 22 by a reciprocating stitcher head 24 into a predetermined point on the stack of sheets 12 such as an upper corner as shown in FIG. 1.

Positioned opposite the stitcher head 24 is a clinching head 26 operated by pneumatic pressure in this example. The clincher head 26 bends the ends of the staple 16 inward upon themselves once the staple is forced completely through the stack. The resulting stapled stack is output to an output point 28 as shown in FIG. 1. As will be described further below, this invention has as an object the formation of improved staples by providing an improved clincher head. This invention also has as an object the stitching of variable thickness stacks of pages without requiring adjustment of the staple length.

SUMMARY OF THE INVENTION

A power stapler according to this invention provides an improved clincher head for use in conjunction with a stitcher that drives staples through a stack of sheets. The clincher head includes clinchers that abut a stop that limits travel of the clinchers into the clincher head. Accordingly, as the staple is driven through the stack of sheets, its ends are brought into contact with the partially retracted clinchers. The angle at which the clinchers are positioned in their partially retracted, stopped, state is chosen so that the driven staple ends plastically deform inwardly toward themselves as they contact the grooved faces of the clinchers. The grooves within the faces of the clinchers are arranged at angles so that the guided ends of the staples moving therealong miss each other. This enables the use of a constant length staple in which ends would normally strike each other. The plastic deformation results in permanent inwardly disposed bends in each of the staple ends. When the final clinching step occurs and the clinchers are extended, the inwardly directed bends are driven into the face of the sheet stack. The finished staple, therefore, more closely resembles a conventional manually formed staple and is less likely to grab onto clothing and skin and more firmly binds the sheets together.

In a preferred embodiment in which a clincher bar is utilized to activate the clinchers, a stop can be mounted in the clincher head that interacts with a slot in the bar. The slot is sized and arranged to prevent retraction of the bar so that the clinchers rest on the bar in a partially retracted state and both the bar and the clinchers are prevented from full retraction into the head, thus forming the desired angle for forming inwardly directed bends in the staple ends.

BRIEF DESCRIPTION OF THE DRAWINGS

The foregoing and other objects and advantages of the invention will become more clear with reference to the following detailed description of the preferred embodiments as illustrated by the drawings in which.

DETAILED DESCRIPTION OF THE PREFERRED EMBODIMENT

Figure 1:
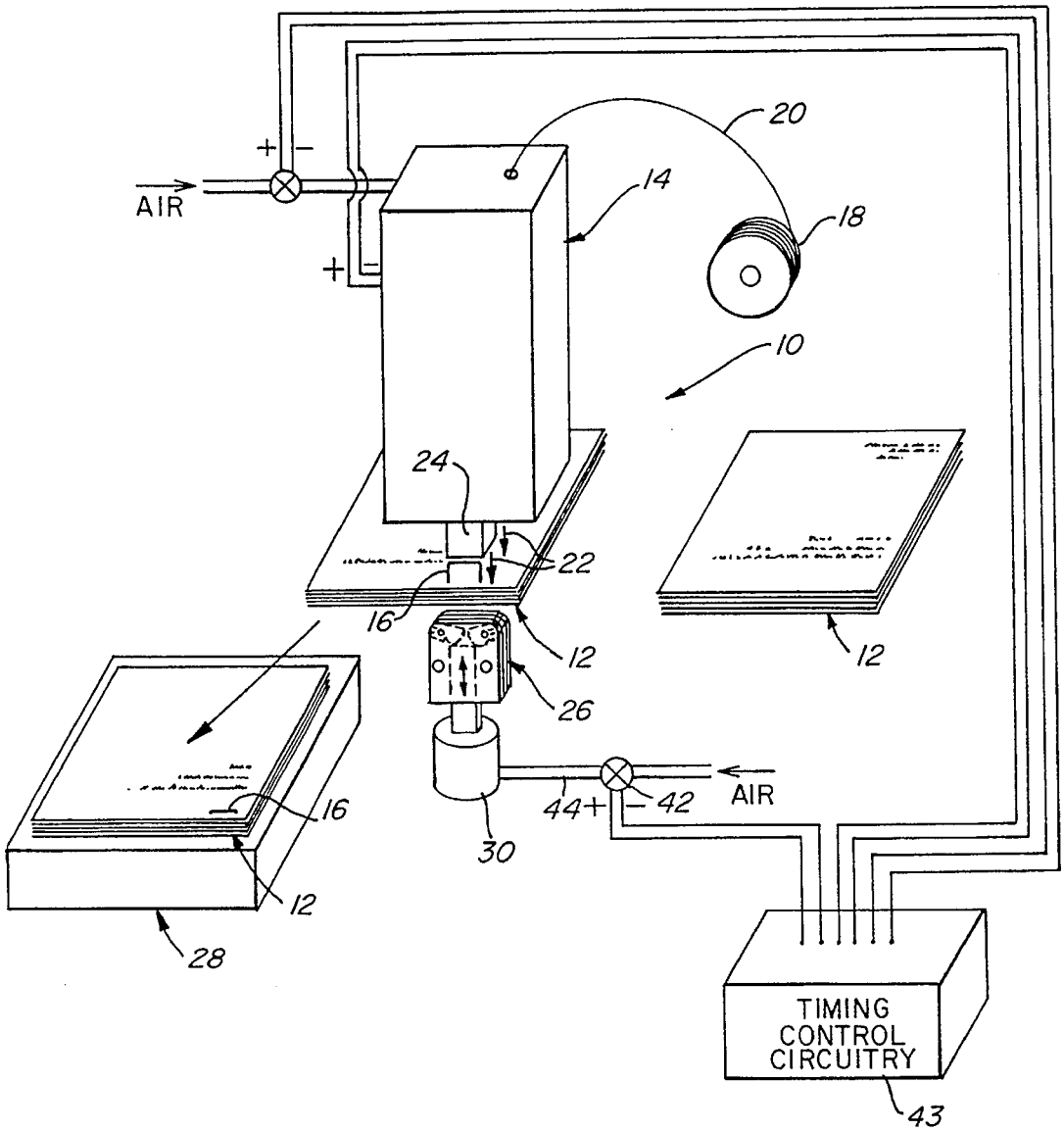
Fig. 1 (PRIOR ART)
FIG. 1 is a schematic perspective view of a stitcher mechanism and the stapling process according to this invention.

As discussed above, a stitching implementation according to FIG. 1 can be utilized according to this invention in order to bind sheets in a stack together using staples 16. The stitcher head 24 forms and drives staples 16 through the stack and the clinching head 26 subsequently, by means of a pneumatic actuator 30, bends the ends of the staple 16 passing through the stack 12 to bind the staple 16 to the stack 12. While the stitcher 14 in this example is located above the clincher head 26 in this implementation, it can be preferred in some embodiments to locate the clincher head 26 above the stack 12. As used herein "above" and "below" will refer to orientation of components relative to the clincher head surface 54 and not to the orientation of components relative to the ground.

FIG. 2 and FIGS. 3A–C further detail a prior art clincher head. The head 26 comprises a block 32 that can include two core pieces 34 along the sides of the head 26 and outer plates 36 bolted to the core pieces to form a hollow interior channel 38. The lower portion of the channel 38 is substantially rectangular and allows a clincher bar 40 constructed, generally, of hardened steel to slide therein. The bar 40 can move along the channel 38 as shown by the double arrow 41. The bar 40 is connected to a pneumatic actuator 30 that advances and retracts the bar 40 upon application of pressure. The stitcher according to this invention includes timing circuitry or controller 43 (shown schematically in FIGS. 1 and 2) that controls the timing of staple formation, staple driving and clinching respectively. Clinching, in general, is the final step in the process. A valve 42 on the actuator air line 44 that is connected to the timing control circuitry governs the application of air pressure to the actuator 30.

The bar 40 acts to move a pair of clinchers 46 located at the uppermost end of the clincher head 32. The clinchers 46 are seated between the outer plates 36 on pivots 48. The clinchers 46 have flattened upper surfaces 50 that, according to this embodiment, include grooves 52 for guiding a staple wire therealong. The clinchers 46 rotate on the pivots 48 between a fully retracted position in which the clincher upper surfaces 50 define an angle A with the flat upper surface 54 of the clincher head 32, and a fully extended position in which the upper surfaces 50 pass out of the clincher head (as shown in phantom). The clinchers 46 according to this embodiment can be pivoted upwardly out of the head surface for removal by aligning the rear slots 56 of the clinchers 46 with the thinner cross section of their rectangular pivot 48. However, removability of the clinchers 46 is not necessary according to this invention.

In a fully retracted state (shown by solid lines), the bar 40 is substantially out of contact with the clinchers 46 so as to allow them to retract fully into the clincher head 32, hence defining the angle A. The bar 40 can be extended upon actuation as shown by the extended bar (in phantom) to force the clinchers 46 beyond the upper surface 54 of the head 32. Practically, the opposing stitcher head 24, as shown in FIG. 1, limits the outward extension of the clinchers 46. This is further illustrated in FIGS. 3A–C which will now be described.

Figure 3A:
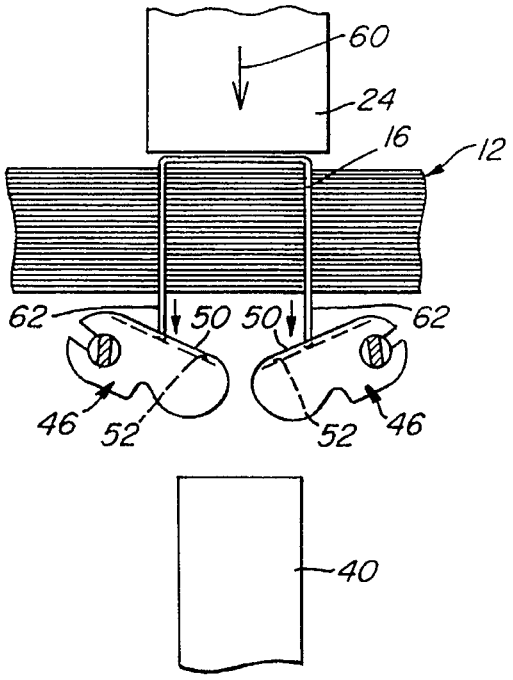
Fig. 3A (PRIOR ART)
FIGS. 3A–C are somewhat more detailed schematic side views of the clinching process according to the prior art.

In FIG. 3A, the staple 16 is driven (arrow 60) through the sheet stack 12 by the stitcher head 24 until the staple ends 62 pass out of the opposing side of the stack and into contact with the upper surfaces 50 of the clinchers 46. Since the clinchers 46 are retracted and the clincher bar 40 is not extended into contact with the clinchers 46, the staple ends 62 remain relatively straight at this time.

Figure 3B:
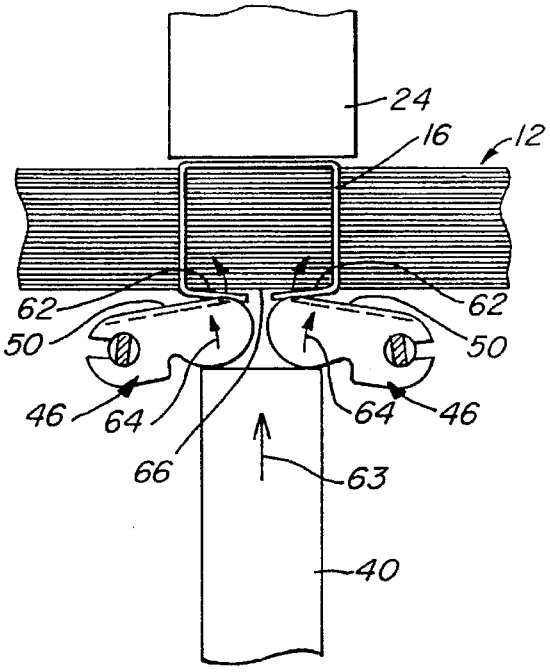
Fig. 3B (PRIOR ART)

FIG. 3B illustrates the step following driving of the staple 16 by the stitcher head 24. The bar 40 is then extended upwardly (arrow 63) so as to rotate the clinchers 46 toward the staple ends as shown by the arrows 64. Accordingly, the staple ends 62 rotate about the bottom face 66 of the stack 12 until the ends are brought into parallel alignment with the bottom face 66 of the stack 12.

Figure 3C:
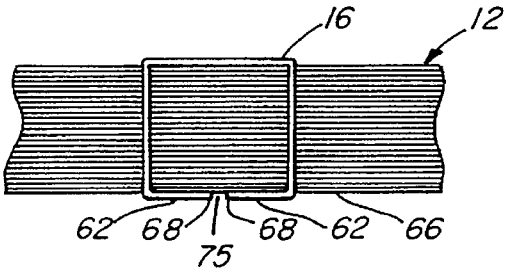
Fig. 3C (PRIOR ART)

At this time, the stack 12 has been firmly bound by the staple 16 as shown in FIG. 3C and is ready for output from the stitcher mechanism.

The extreme retraction of the clinchers 46 as shown in FIGS. 2 and 3A–C causes the ends 62 of the staple to bend into virtually parallel alignment with the stack bottom face 66 (see FIG. 3C). The bent ends 62 of the staple 16 are, thus, somewhat unlike those formed by the manual staplers in which the tips 68 of the bent ends 62 are driven back into the lower face of the stack and often dig into the face. As a practical matter, the parallel ends 62 generated by a power stitcher can catch on clothing, often include burrs that abrade skin causing cuts and are more prone to become unbent and allow the stack to unbind.

Figure 2:
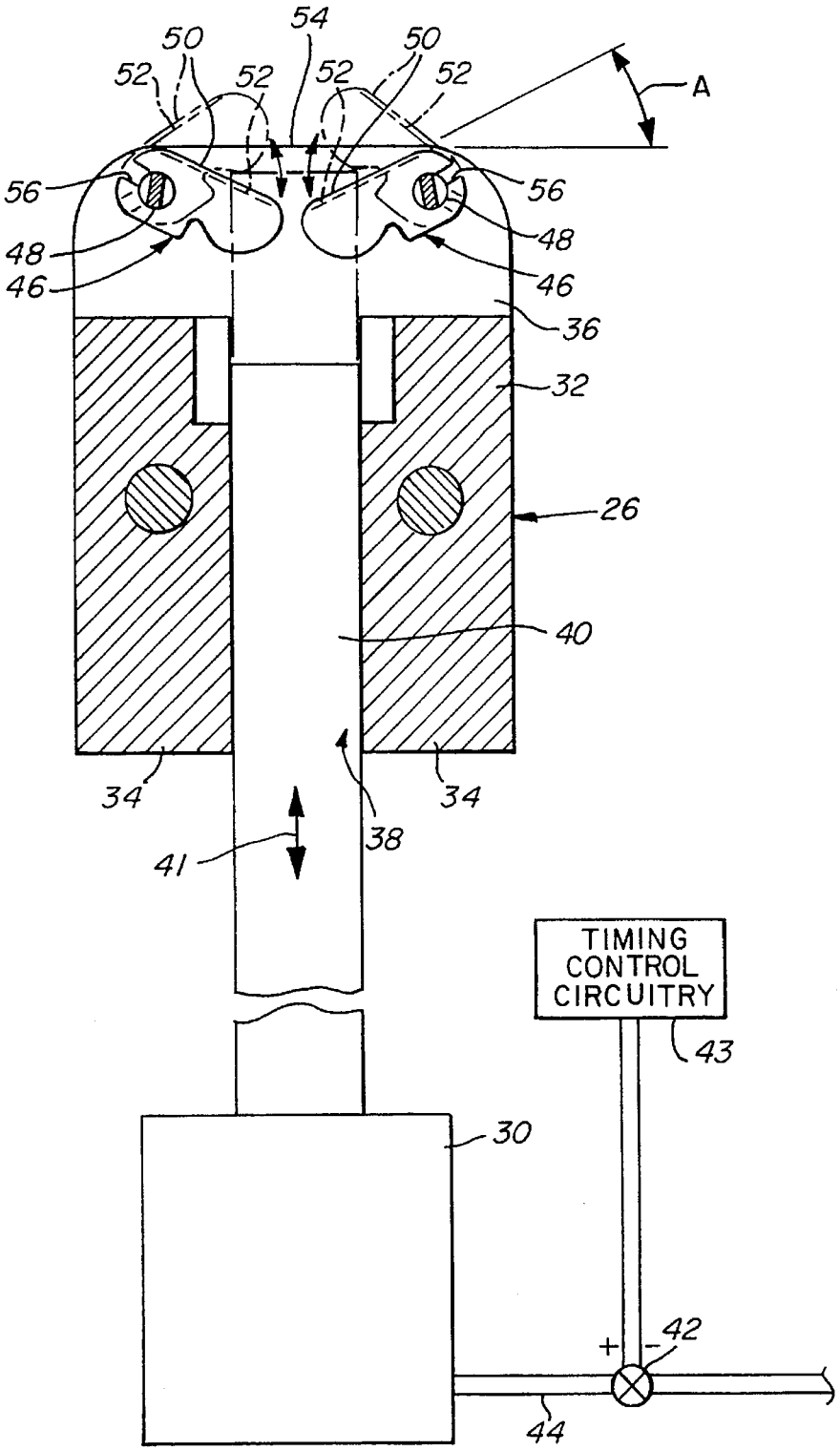
Fig. 2 (PRIOR ART)
FIG. 2 is a more detailed cross-sectional side view of a clincher head according to the prior art.
Figure 4:
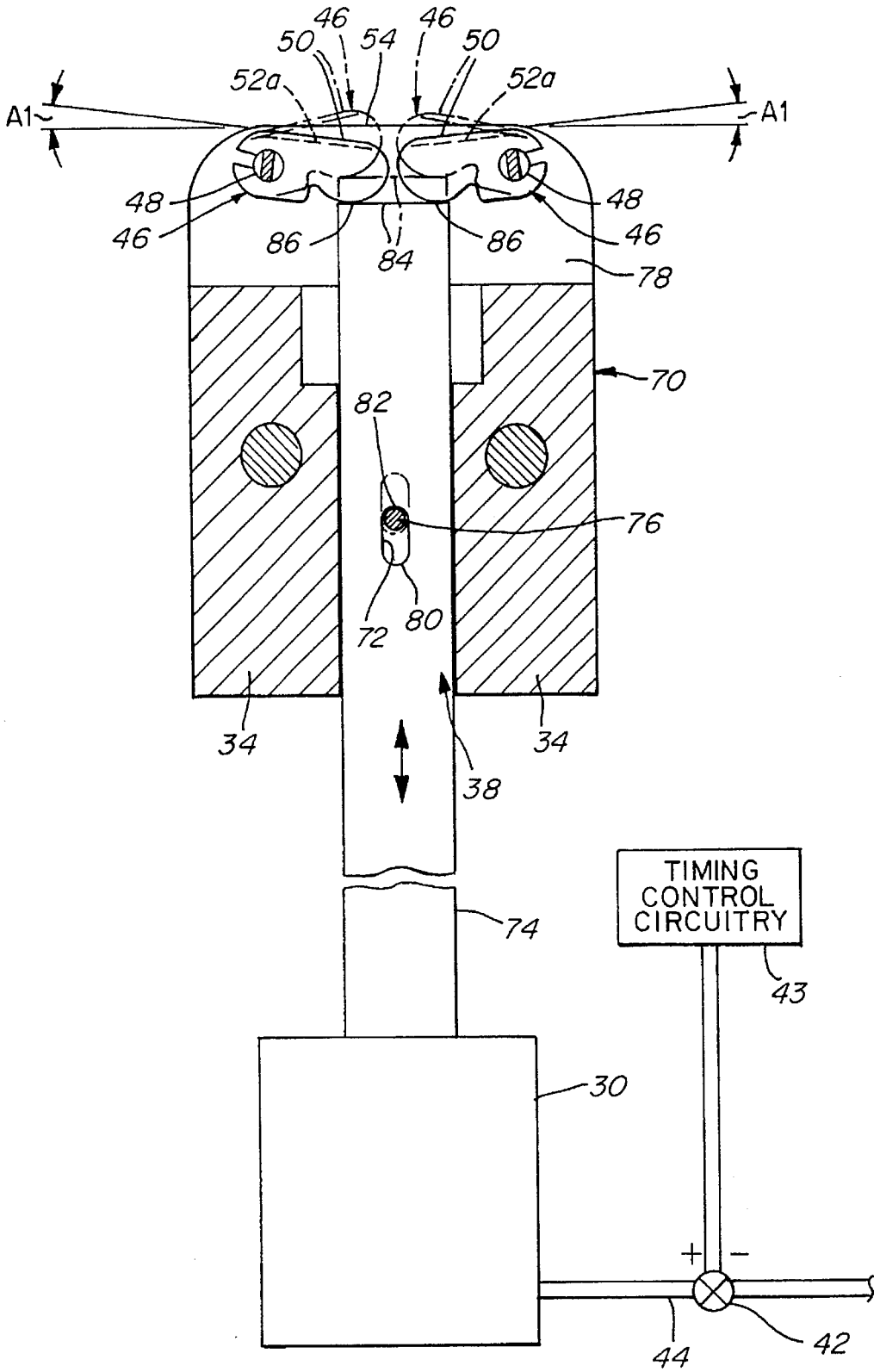
FIG. 4 is a cross-sectional side view of a clincher head according to this invention.

FIG. 4 illustrates an improvement to the clincher head 26 of FIG. 2 in which a clincher head 70 is provided that limits retraction of the clinchers 46. Hence, the angle A1 defined between the upper surfaces 50 of the retracted clinchers 46 and the surface 54 of the clincher head 70 is reduced from the angle A of FIG. 2. Such a reduction is facilitated according to this embodiment by forming a channel 72 in the clincher bar 74 and inserting through passing bolt or stake 76 in which the channel 72 rides. The stake 76 is held by the outer head plates 78 which include holes for retaining the stake 76. The length channel 72 is chosen so that the lower end 80 of the channel 72 still allows maximum extension of the bar 74 (as shown in phantom), but the upper end 82 of the channel 72 limits retraction of the bar 74. Retraction of the bar 74 is limited so that the clinchers 46 remain in contact with the upper end 84 of the bar 74 and define therewith an angle A1.

While the bar 74 in this embodiment is used to limit retraction of the clinchers 46 so as to define the angle A1, other methods of limiting clincher 46 retraction are expressly contemplated according to this invention. For example, each clincher 46 can have associated therewith its own stake or bolt that limits retraction. The clinchers can also be formed so that lower ends 86 thereof contact the central blocks 34 of the clincher 46 upon a certain predetermined degree of retraction. The blocks 34 would have to be lengthened or the lower ends 86 of the clinchers 46 would have to be extended to limit retraction to the appropriate angle A1. These alternatives are not shown but are expressly contemplated.

The angle A1 is chosen, according to this embodiment, based upon usually trial and error so that an optimum shape for the staple end 62 is generated. The angle A1 causes formation of staples with ends 62 as illustrated in FIGS. 5A–D which will be described further below.

As stack thicknesses vary, it is normally desirable to vary the length of the staple. In this manner, the ends of the staple are spaced from each other when the staple is clinched as shown by the space 75 in FIG. 3C. Otherwise, the ends of the staple, which are normally collinear (i.e. both along the same line which in this example is perpendicular to the axes of the clincher pivots 48), tend to strike each other causing a defective stitch.

Figure 4A:
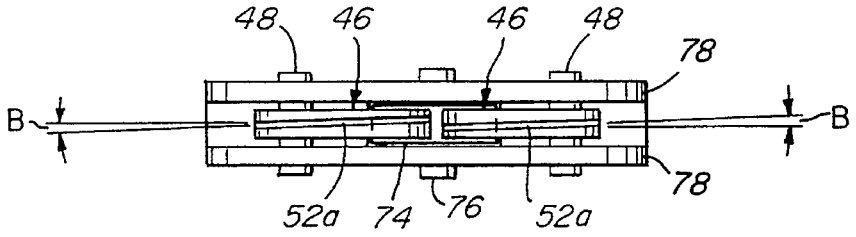
FIG. 4A is a top view of the clincher head according to FIG. 4.

The clinchers 46 according to this embodiment include grooves 52*a* that are angled relative to each other as illustrated in FIG. 4A. Each groove 52*a* is offset by an acute angle B to grooves define noncollinear lines that are parallel to each other. Thus, staple ends riding within the grooves 52*a* tend to pass each other even if they are long enough to meet.

Figure 4B:
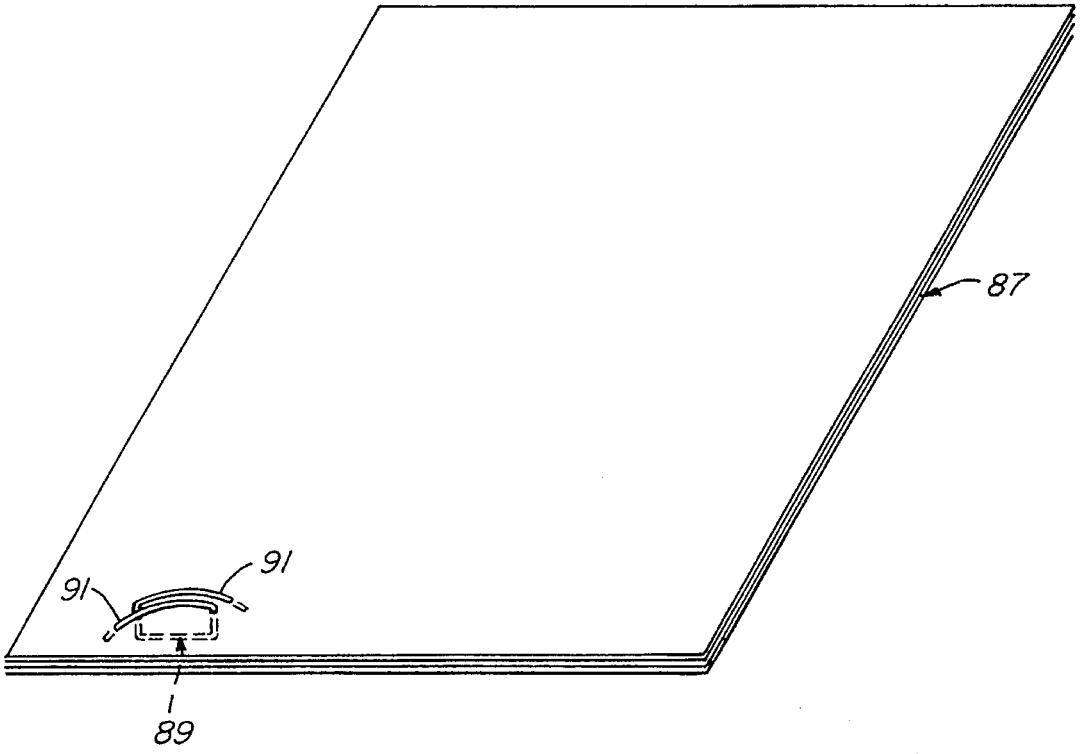
FIG. 4B is a perspective view of a staple formed in a thin stack of sheets using the clincher head according to FIGS. 4 and 4A.

FIG. 4B illustrates a stack 87 that would be considered too thin for the length of staple 89 chosen. Accordingly, in a conventional clincher embodiment in which grooves are aligned along a single common line (i.e. "collinear"), the staple ends 91 would collide. Conversely, however, by utilizing angled grooves 52*a* according to this embodiment, the ends 91, upon clinching, pass by each other and do not interfere with each other.

Figure 5A:
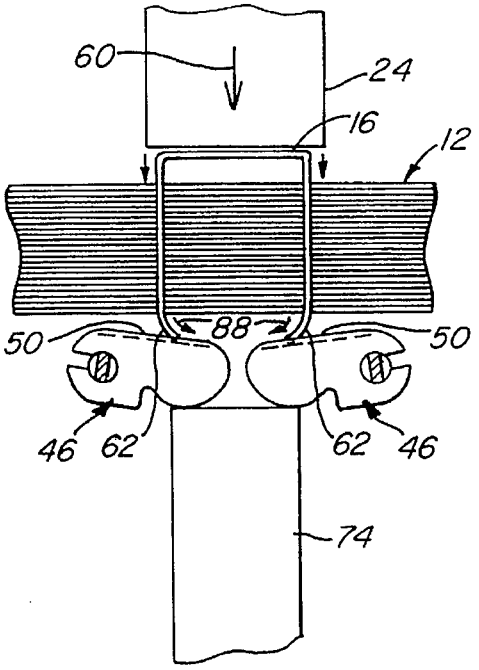
FIGS. 5A–D are somewhat schematic side views of the clinching process according to this invention.

Referring now to the operation of the stitcher according to this embodiment, FIG. 5A illustrates the driving of a staple 16 through a stack of sheets 12. The stitcher head 24 is still in the process of driving (arrow 60) the staple when the ends 62 contact the retracted clinchers 46 that are shown resting on the clincher bar 74 in a less retracted state than in FIGS. 3A–C. As such, the staple ends 62 begin to bend toward each other (arrows 88) along the slightly downwardly angled slopes of the clincher upper surfaces 50.

Figure 5B:
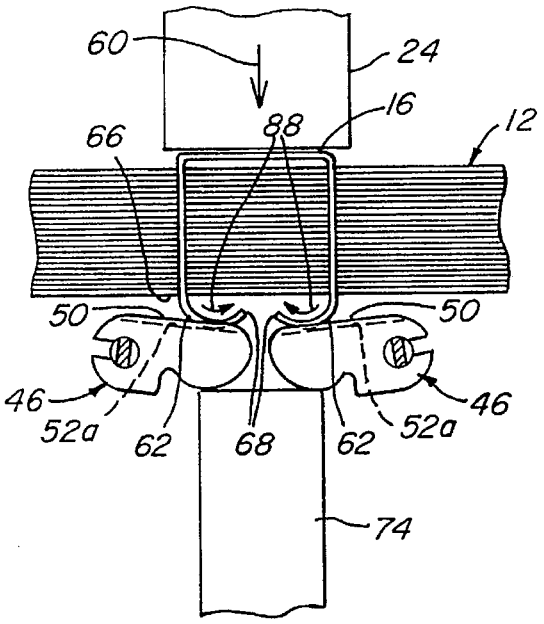

As the staple 16 is fully driven into the stack as shown in FIG. 5B, the tips 68 of the staple end 62 have bent inwardly slightly toward the lower stack face 66. The clinchers 46 have not yet moved upwardly under the force of the bar 74, but are at this time only resting on the bar 74. The reason the tips 68 bend in slightly is that, unlike the example of FIG. 2, the angle A1 of the less retracted clinchers 46 of this embodiment are chosen so that the bending of the staple end tips 68 imparts a force on the ends 62 that is greater than the elastic limit of the staple wire. The fully retracted clinchers 46 of FIG. 2 can cause slight bending of the ends 62, but this bending does not impart a force that exceeds the elastic limit of the staple wire. Hence, only the final clinching step (FIG. 3B) results in plastic deformation of the staple wire. This final clinching step (FIG. 3B) thus, causes a full 90° bend in the staple 16 proximate its exit point from the lower stack face 66. Conversely, plastic deformation of the staple ends 62 according to this example begins before any movement of the clinchers 46 in the clinching step. The angle A1 insures that the bending of the ends 62 orients the tips 68 of the staple back inwardly toward the lower stack face 66.

As discussed above, the angle A1 is typically determined through a trial and error process which is dependent upon the particular type and gage of staple wire being utilized. For example, for a number 24 (0.023 inch diameter) staple wire have a "semihard" temper, the angle A1 should have a preferred value of 25°. Such an angle will insure the formation of a curled-in bend in the ends of the staple. If a thicker wire is utilized, the angle A1 may require reduction in order to permit proper plastic deformation of the ends. This is because the modulus of elasticity for such a wire increases substantially as the cross sectional area of the wire increases. Such thicker wire can be desirable where a substantial quantity of sheets are penetrated by staple. Given such a quantity, added staple rigidity prevents buckling or warping of the staple ends as they pass through the sheets. Similarly, using a harder wire may entail a reduction in the angle A1.

In order to determine the angle A1 for a given gage and hardness of wire, the operator can first start from the basic angle A1 of 25°. For harder wire, the operator then may perform a stapling operation with the differing size/hardness wire at the same angle (25°). If the desired inward curl is obtained, then no further adjustment may be required. However, if the desired curl is not generated, then the operator can then incrementally (by approximately 1°–2°) change the angle, making it either steeper or shallower. After each change in angle, the operator can then test the results of the change by performing a stapling operation and inspecting the shape of the staple ends. When a desired curled-in shape is obtained, no further change should be made in the angle value. As will be described further below, the angle A1 can be varied using different size stop pins that change the maximum retracted point of the clincher bar.

Figure 5C:
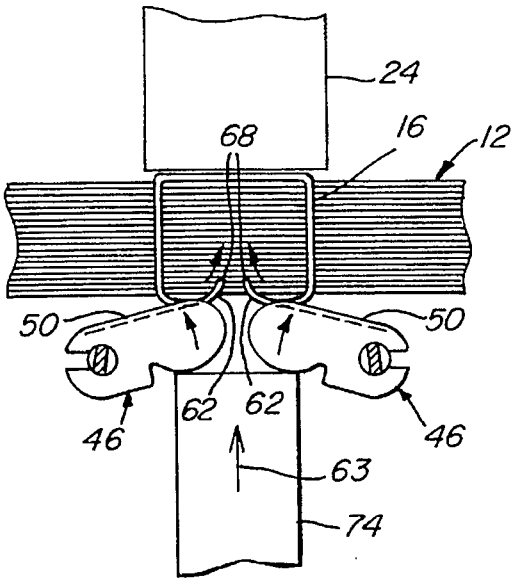
Figure 5D:
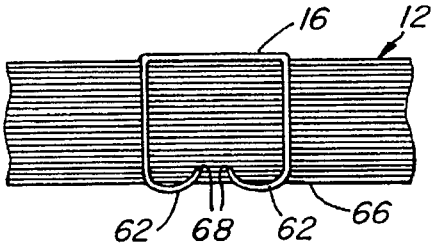

When the clinching 46 step occurs as shown in FIG. 5C, the inwardly bent tips 68 are forced back into the lower stack face 66. The tips, thus, form a more traditional curled-in staple end 62 as shown in FIG. 5D. The inwardly directed tips 68 are not as prone to grab on clothing or skin and serve to more firmly bind the stack of sheets together.

While the clinchers 46 according to this embodiment are angled to form as large a curve in the staple end 62 as possible, certain types of staple wire may be more resistant to plastic deformation than others. Thus, the angle A1 should be at least sufficient to cause the ends 62 of the staples to plasticly deform slightly. The inward curl of the staple 16 need not be pronounced to attain a desired result. Even a slight inwardly projected bend in the staple end 62 will prevent grabbing and enhance grip of the staple 16 on the sheet back 12. The staple 16 can still carry a shape substantially similar to that of more conventional power stitchers except that the tips are now directed toward the stack face and are generally aligned along parallel angled lines.

Figure 6:
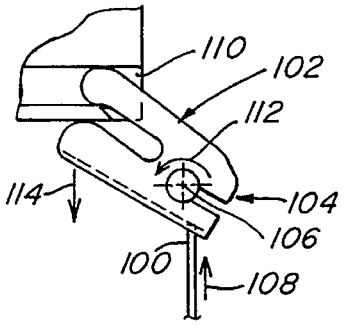
FIG. 6 is a somewhat schematic side view of the rotational forces imparted on a clincher by a misaligned staple end.

On occasion, the ends of staples will become misaligned laterally relative to the clincher head. FIG. 6, for example, illustrates a staple end 100 striking a clincher 102 near the clincher's pivot end 104. In this embodiment, the clinchers each include an extension of their clinching surface at the pivot end 104 that is located outwardly of the pivot axis 106. Accordingly, the driving force of the staple 100 (arrow 108), rather than directing the clinchers downwardly toward the clincher bar 110, generates an opposing moment (arrow 112) about the pivot axis 106 that drives the clincher 102 back toward the sheets (arrow 114). This prevents the desired bend from forming at the staple end 100 and, conversely, may cause the staple to buckle outwardly.

Figure 7:
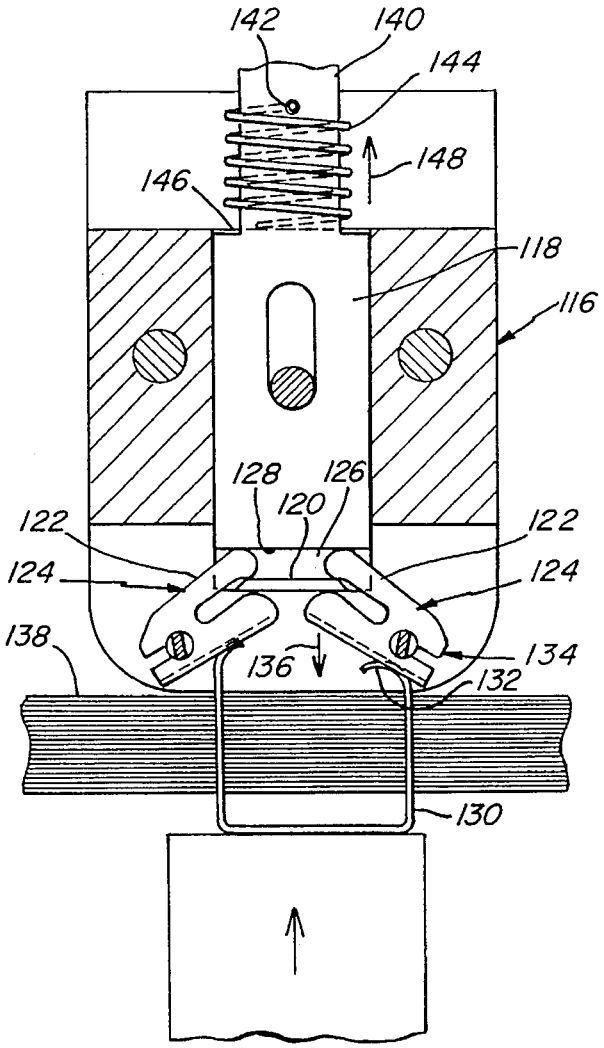
FIG. 7 is a somewhat schematic cross sectional side view of a clincher head assembly according to an alternate embodiment.

FIG. 7, thus, details an alternate embodiment according to this invention in which the clincher head 116 includes a clincher bar 118 having a shoulder 120 at its lower end that receives a pair of lower extensions 122 on each of the clinchers 124. The lower extensions 122 are, thus, retained against upward and downward pivoting within a well 126 formed between the shoulder 120 and an opposing shoulder 128. Thus, a misaligned staple 130, wherein the staple end 132 is located adjacent an outward end 134 of the clincher 124, would normally bear upon the clincher to cause it, and the clincher bar 118 to move downwardly (arrow 136) into the sheet stack 138. However, the clincher bar 118 according to this embodiment includes a narrowed stem 140 having an aperture 142 that receives a compression coil spring 144. The coil spring bears upon side shoulders 146 (shown in phantom) in the clincher head 116. The spring 144, thus, resists downward force (arrow 136) generated by the misaligned staple 130 with a resistive force (arrow 148).

The spring 144 need only generate a pound or less of resistance force. This is because the amount of force required to plastically deform the staple ends is relatively small and, hence, if the staple end plastically deforms before the resistance force of the spring 144 is overcome, then the staple end will be properly guided along the clincher. As a practical matter, the force can be set so that it is approximately twice the force generated by contact of the staple ends against the clinchers which, itself, can be measured using a force guage on the clincher bar while it floats out of contact with its actuator.

Figure 8:
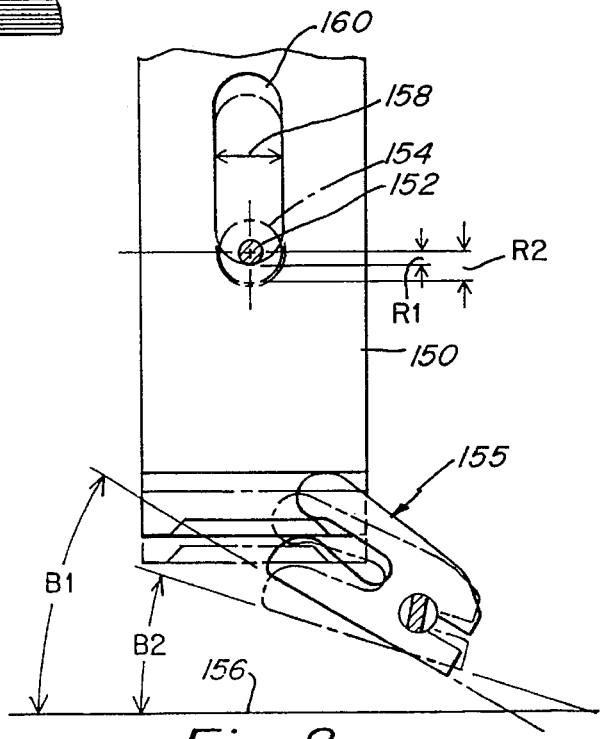
FIG. 8 is a somewhat schematic partial side view of a clincher bar and a clincher head according to another alternate embodiment.

As described above, the angle defined between the clincher surface and the plane of the clincher head can be made adjustable to account for differences in thickness and hardness of staple wire. As depicted in FIG. 8, the diameter of the stop pin can be varied to vary the maximum retracted position of the clincher bar 150. This figure illustrates two stop pins, a smaller diameter pin 152 and a larger diameter pin 154 (shown in phantom). When the small diameter pin 152 is located in the clincher head, the clincher bar can be retracted to define the angle B1 relative to the horizontal plane 156. However, when a larger diameter pin 154 (shown in phantom) is utilized, the maximum angle defined between the clinchers 155 and the horizontal 156 is reduced to B2.

The difference in pin radii (R1 for small pin 152 and R2 for large pin 154) accounts for the change in maximum retraction position of the clincher bar 150. The further the clincher bar is free to retract, the larger the angle defined between the clincher surface and the horizontal 156. Hence, by providing stop pins with a variety of differing radii or diameters, it is possible to precisely vary the angle defined between the clincher surface and the horizontal. The maximum diameter of the stop is limited only by the width 158 of the clincher bar slot 160. The pin, essentially, must be able to pass through the slot and, thus, the maximum diameter is limited to the width 158 of the slot 160. Alternatively, the stop pin must be large enough in diameter to resist impact forces on the clinchers and as a result of the pneumatic cylinder and compression spring described in FIG. 7. The use of a hardened steel pin is desirable for providing sufficient strength to absorb such impacts.

According to this invention, a variety of specific diameter pins can be provided in a kit, wherein each pin corresponds to a specific size or range of sizes of staple wire diameter, hardness of staple wire or, in certain cases, thicknesses of sheets to be stapled, since a short extending staple end may require a different angle than a longer extending staple end in order to form the desirable curled-in shape. Choice of the correct pin can be provided either by cross-indexing the pin to the known staple wire characteristics, or alternatively, by switching different pin diameters in the clincher head until the one that provides the desired curled-in shape to the staple ends is selected. The operator can select a pin in this manner by beginning with a standard intermediate size and stepping up or down through the various diameters provided. Alternatively, the operator can machine his or her own pin, having appropriate hardness, if a certain pin size is unavailable.

In order to mount a stop pin according to this embodiment, the clincher head can be provided with at least one access hole having a retaining plate thereover. The retaining plate is removed to expose the access hole through which a pin is inserted. The pin passes through the clincher head and also through the slot 160 in the clincher bar. The pin, typically, can include a pair of standard size ends with a variable diameter center. In this manner, the pin will always be centered in standard size orifices positioned in the sides of the clincher head while the center of the pin varies in diameter to engage the slot 160 of the clincher bar 150.

The foregoing has been a detailed description of a preferred embodiment. Various modifications and equivalents can be made without departing from the spirit and scope of this invention. This description is, therefore, meant to be taken only by way of example and not to otherwise limit the scope of the invention.

What is claimed is:

1. A clincher assembly for use with a power stapler that operates the clincher assembly to form completed staples, the clincher assembly comprising:

a clincher head defining a plane for engaging a face of a stack of sheets positioned above the plane;

a pair of clinchers having substantially linear surfaces for engaging ends of the staple, the staple being driven by the power stapler through the stack of sheets so that the ends thereof are substantially transverse to the plane and pass through the plane into engagement with the clinchers, the clinchers being pivotally mounted in the clincher head so as to pivot between positions below and positions substantially within the plane to form a bend in the ends at a first location therealong so that the ends are brought into engagement with the stack of sheets;

a clincher bar positioned below the clinchers, with respect to the stack of sheets, the clincher bar being operatively connected to the clinchers, for forcibly pivoting the clinchers upwardly toward the plane from the position below the plane in response to linear movement of the clincher bar in an upward linear movement direction, the clincher bar including a slot that is elongated along a direction of elongation aligned substantially along the linear movement direction of the clincher bar, the slot having an upper end and a lower end aligned substantially along the direction of elongation; and a stop structure that passes through the slot and that is fixed in position relative to the plane, the clincher bar being movable along the linear movement direction within a predetermined range of linear motion wherein the stop structure engages each of the opposing upper end and lower end of the slot and wherein each of the stop structure and the upper end of the slot are located so that, when the upper end and the stop structure are in contact with each other, the clincher bar is positioned so that each of the clinchers are located at the position below the plane wherein the linear surfaces define an angle A1 relative to the plane, wherein the angle A1 is approximately 25 degrees whereby the ends of the staple are plastically deformed to form curved shapes that face each other as the ends are driven by the power stapler through the stack and into contact with each of the clinchers.

2. A clincher assembly as set forth in claim 1 further comprising a spring that biases the clinchers so that the linear surfaces define the angle A1, the spring having a force that is sufficient to maintain the clinchers at the angle A1 against a plastic deformation force exerted by the ends of the staple as the staple is driven against any portion of the substantially linear surfaces of the clinchers, but the spring force being overcome when the clinchers pivot substantially into the plane by a predetermined driving force imparted to the clinchers.

3. A clincher assembly as set forth in claim 2 wherein the spring is a compression spring and is located adjacent the clincher bar to bias the clincher bar so that the upper end of the slot engages the stop structure.

4. A clincher assembly as set forth in claim 1 wherein each of the clinchers includes grooves for guiding the ends of the staples therealong.

5. A clincher assembly as set forth in claim 1 wherein the stop structure comprises a plurality of interchangeable shafts that are each locatable through the elongated slot wherein each of the plurality of shafts enables the clincher bar to move to a predetermined maximum location wherein a plurality of different corresponding angles A1 can be defined between the plane and the linear surfaces thereby.

6. A clincher assembly as set forth in claim 1 wherein the stop structure is locatable relative to the slot so that an engaging surface of the stop structure engages the upper end of the slot at a plurality of locations that are selectable by an operator to cause the clinchers to be pivotally located at a plurality of values of angle A1 corresponding to each of a plurality of locations of the engaging surface of the stop structure.

7. A clincher assembly for use in a power stapler comprising:

a clincher head defining a plane for receiving a face of a stack of sheets positioned above the plane;

a pair of clinchers having substantially linear surfaces for engaging ends of a staple that is driven through the stack of sheets in a direction downwardly toward the clinchers;

the clinchers each including a respective pivot so that the clinchers move pivotally relative to the clincher head between a position substantially below the plane and a position substantially within the plane;

a clincher bar that is operatively connected with and that contacts the clinchers and that moves substantially linearly along a direction of linear motion to cause the clinchers to pivot between the position substantially below the plane to the position substantially within the plane to bend the ends of the staple so that the ends engage the stack; and wherein the clincher bar includes an elongated slot having a direction of elongation aligned substantially along the direction of linear motion and a shaft located through the elongated slot and substantially fixed relative to the plane, the slot having an upper end and a lower end and the shaft being located so that the upper end is in engagement with the shaft when the clincher bar is located at a position that, thereby, pivotally locates the clinchers so that the linear surfaces each define an angle A1 of approximately 25 degrees whereby the ends of the staple are formed into curves as the ends are driven downwardly into engagement with the linear surfaces.

8. A clincher assembly as set forth in claim 7 further comprising a plurality of interchangeable shafts that are each locatable through the elongated slot wherein each of the plurality of shafts enables the clincher bar to move to a predetermined maximum location wherein a plurality of different corresponding angles A1 can be defined between the plane and the linear surfaces thereby.

9. A clincher assembly as set forth in claim 7 wherein the clincher bar includes a shoulder that engages the clinchers and a spring that biases the clinchers, via the shoulder to define the angle A1, the spring having a force that resists movement of the clinchers in response to a driving of the ends of the staple onto the clinchers, the force being overcome by a substantially linear movement of the clincher bar to drive the clinchers to the position substantially within the plane.

* * * * *